United States Patent [19]

Ushikoshi et al.

[11] 4,365,899

[45] Dec. 28, 1982

[54] GEAR TRAIN OF AN ELECTRONIC TIMEPIECE

[75] Inventors: Kenichi Ushikoshi; Imao Hiraga, both of Suwa, Japan

[73] Assignee: Kabushiki Kaisha Suwa Seikosha, Tokyo, Japan

[21] Appl. No.: 151,075

[22] Filed: May 19, 1980

Related U.S. Application Data

[63] Continuation of Ser. No. 862,480, Dec. 21, 1977, abandoned.

[51] Int. Cl.[3] ..... G04B 19/02

[52] U.S. Cl. ..... 368/220

[58] Field of Search ..... 368/76, 80, 220, 322, 368/323

[56] References Cited

U.S. PATENT DOCUMENTS

| | | | |
|---|---|---|---|
| 3,860,844 | 1/1975 | Hetzel | 310/104 |
| 4,090,352 | 5/1978 | Jeannet et al. | 368/220 |
| 4,123,895 | 11/1928 | Miyazaki | 368/155 |
| 4,127,984 | 12/1978 | Ogihara et al. | 368/222 |

*Primary Examiner*—Vit W. Miska

*Attorney, Agent, or Firm*—Blum, Kapalan, Friedman, Silberman & Beran

[57] ABSTRACT

The size of an electronic timepiece is decreased through improvement in the design of the gear train. The improvements are directed primarily to the number of teeth on the wheel attached to the seconds hand and the relation of the pitch interval of this wheel to that of the wheel which drives the seconds wheel.

11 Claims, 10 Drawing Figures

GEAR TRAIN OF AN ELECTRONIC TIMEPIECE

This is a continuation of application Ser. No. 862,480, filed Dec. 21, 1977, now abandoned.

BACKGROUND OF THE INVENTION

The present invention relates to the gear train of electronic timepieces which are driven by a battery, the object being to produce timepieces of good quality and of substantially reduced size by improvement in the structure of the gear train.

Starting with the initial development of the electronic timepiece, striking progress has been made in the miniaturization of the time standard source and the electronic circuitry through progress in both circuit design and the manufacturing process. Through the utilization of these techniques it has been possible to realize electronic timepieces which are almost as thin as mechanical timepieces. However, although such electronic timepieces are relatively thin, the planar dimensions of such timepieces have been relatively great and it has hitherto been possible to miniaturize the electronic timepices in the planar direction only by eliminating the second hand or by suffering excessive deflection of the second hand.

In order to achieve an electronic timepiece which is small in all three dimensions, the gear train, the battery which provides energy to the gear train and the coil of the motor must be miniaturized and all of these elements must be brought close to the center of the timepiece. Especially important is reduction in the diameter of the fourth wheel and pinion which constitute the seconds wheel composite. Moreover, the transfer efficiency of the gear train must be improved so that the hands can be operated by a small torque and the shape of the coil must be such that it can be miniaturized.

SUMMARY OF THE INVENTION

The gear train of an electronic timepiece is restructured in order to miniaturize the timepiece, particularly in the planar dimensions. In the restructuring, three stages of reduction between the rotor and the gear which rotates the seconds hand are provided. Through the use of three stages rather than the conventional two stages, it becomes possible to reduce the size of the gear train itself without reducing the size of the pinions, reduction in size of the pinions introducing serious production difficulties.

The use of relatively large pinions markedly reduces backlash and, thereby, deflection or uncertainty in location of the seconds hand, thereby contributing to the overall high quality of the final product. The gearing is also simplified by the use of mating pairs of gears in which the pitch interval on one of the gears is twice that of the other.

Accordingly, an object of the present invention is a gear train for an electronic timepiece which provides for reduction in the overall size of the timepiece.

Another object of the present invention is a gear train for an electronic timepiece in which three stages of speed reduction between the rotor and the seconds hand are provided as a means for reducing the size of the timepiece while maintaining the high quality of same.

A further object of the present invention is a gear train for an electronic timepiece in which improved operation is obtained with the use of mating pairs of gears in which the pitch interval of one gear is twice that of its partner.

An important object of the present invention is a gear train for an electronic timepiece in which the pinion gears have a sufficiently great number of teeth so as to minimize the deflection or uncertainty in the location of the seconds hand as it is moved along by said gear train.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
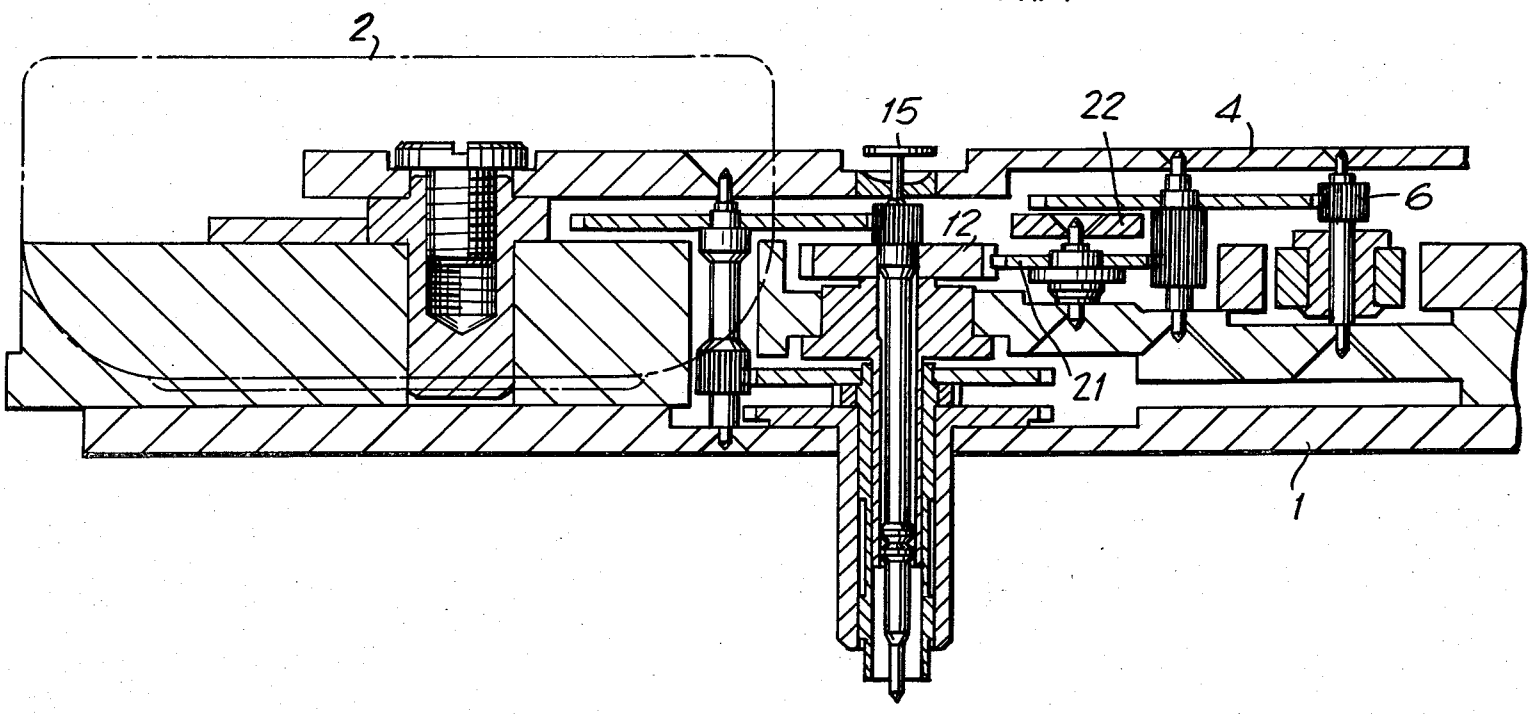
FIG. 1 PRIOR ART
FIG. 1 is a sectional view of the gear train portion of a conventional electronic timepiece of small size.
Figure 2:
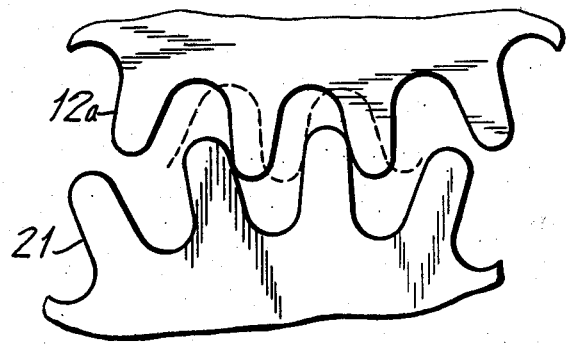
FIG. 2 illustrates the engagement of the fourth wheel and the intermediate wheel.

A conventional gear train using an intermediate wheel 21 is shown in FIG. 1. In this conventional gear train, the fourth wheel which is part of the seconds wheel composite has 30 teeth, and the battery 2 is brought as close to the center of the electronic timepiece as possible. In a quartz crystal timepiece the seconds hand is generally advanced by steps of one second each. With the gear train of FIG. 1, the error in positioning the seconds hand can be as great as 0.5 seconds due to backlash between fourth wheel 12 and intermediate date wheel 21. The source of this deflection is illustrated in FIG. 2 which shows a single position for intermediate wheel 21 and alternate positions for seconds wheel 12. To minimize the hand deflection, it is customary to provide a friction spring (not shown) for the seconds wheel composite so that the seconds hand can be stabilized at the predetermined position between each shift of the hand in the forward direction. The disadvantage of such a friction spring is that it produces a loss of torque amounting to between 10 and 30%.

The output torque of the electric motor of an electronic timepiece can be generally expressed by the formula $$T=A\times t,$$

where A is the current flowing through the coil and t is the number of turns of wire in the coil. Accordingly, the larger the current flowing through the coil and the greater the number of turns, the larger is the output torque. Where the friction spring is used, the required current for operation of the timepiece is about 30% greater than in the constructions in accordance with the present invention which will be described. Alternatively, the number of turns in the coil must be increased by from 10 to 30% to achieve the desired torque. Accordingly, the use of such a friction spring constitutes a serious disadvantage in further reduction of the size of an electronic timepiece.

In addition to the disadvantages with respect to size accruing from the use of a friction spring, incorporation of such a spring requires additional production time as well as materials which must be constructed and assembled with great precision so that the cost of such a structure is great.

Another disadvantage of the conventional construction is that the intermediate wheel 21 which engages the fourth wheel is guided and supported by the sweep second cock 22 so that in addition to the full bridge 4 which guides and supports the fourth wheel and pinion as well as rotor 6, an additional bridge must be provided. Such a bridge requires additional space both for the structure itself as well as for the assembly process. Accordingly, the various factors enumerated militate against reduction in size of the conventional electronic timepieces.

Figure 3:
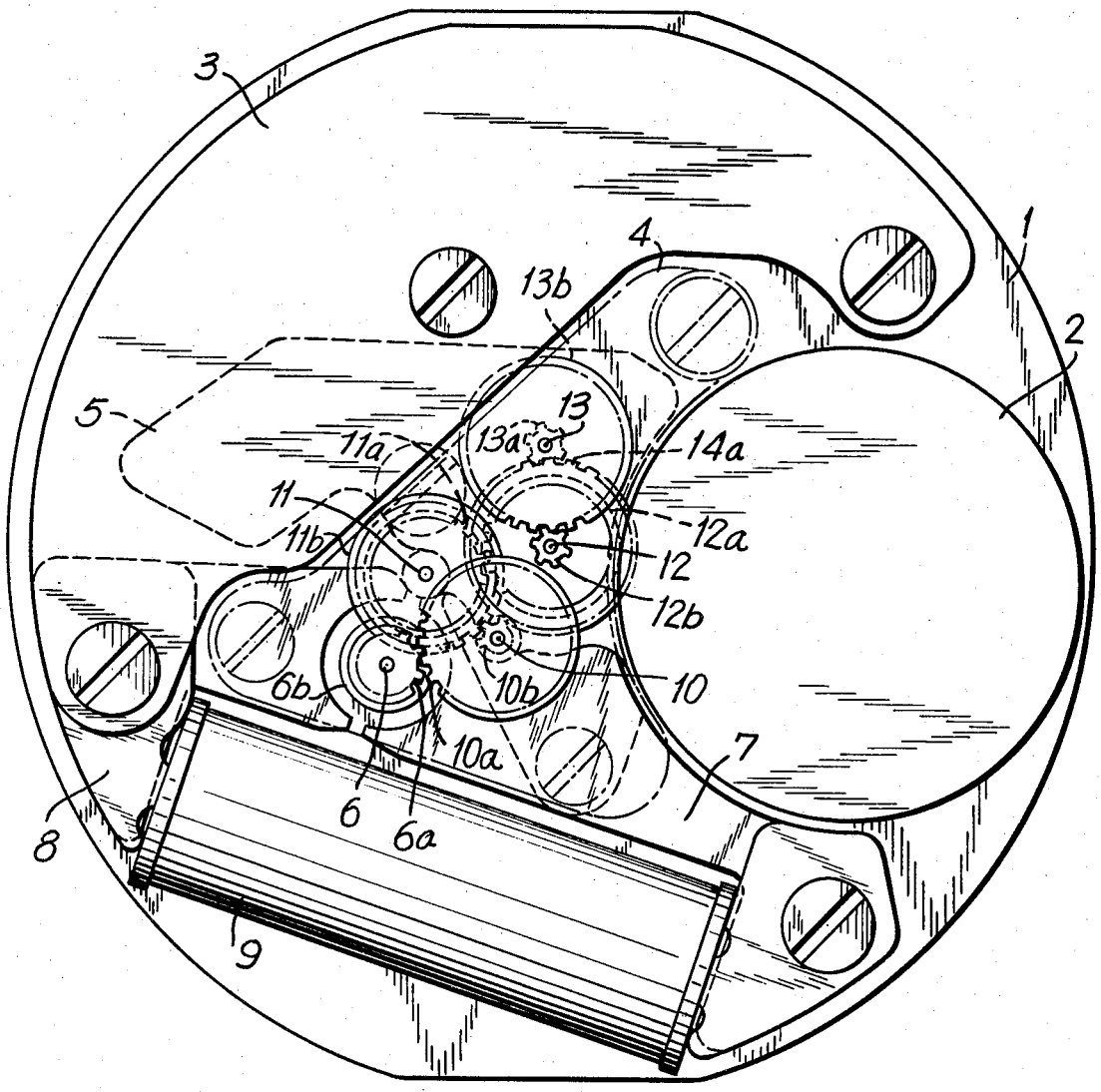
FIG. 3 is a plan view of an embodiment of the present invention.
Figure 4:
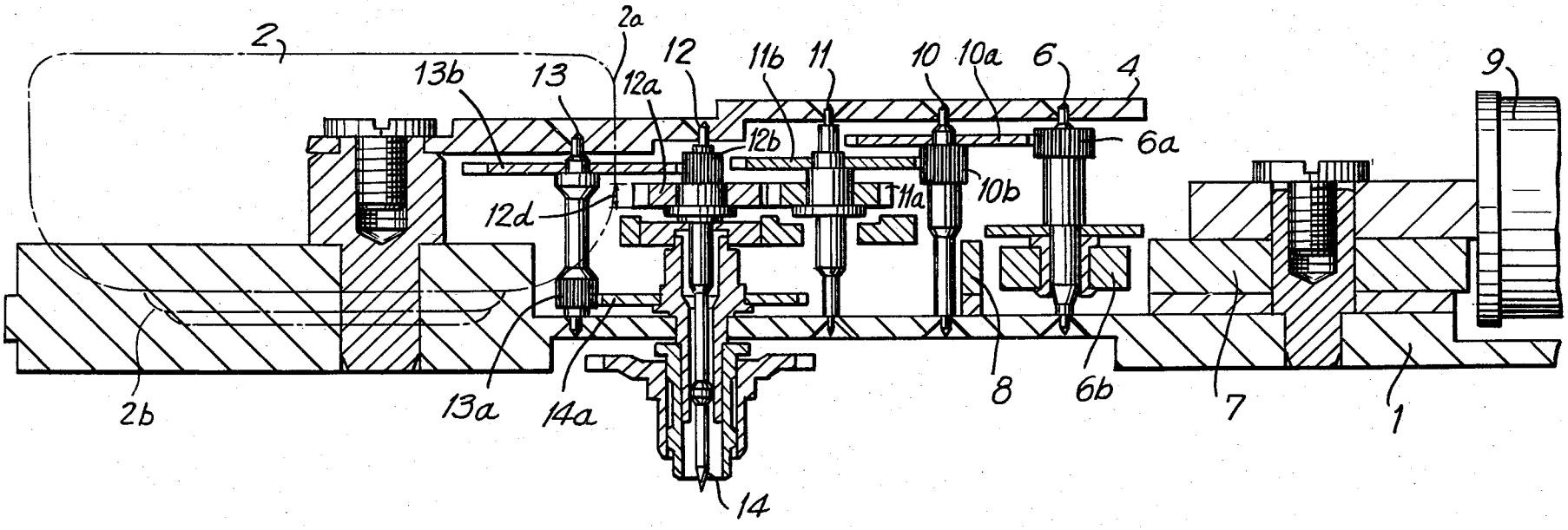
FIG. 4 is an essentially sectional view of the gear train of FIG. 3.

The manner in which the aforenoted difficulties are overcome by the structure of the present invention can be seen from FIGS. 3 and 4 in which plate 1 provides support for battery 2 and electronic circuit block 3 which includes a crystal oscillator which is the time standard source as well as an oscillation circuit, a divider circuit and the other components necessary for transferring pulse signals to rotor **6*b*. Battery 2 is positioned close to the outer periphery of fourth wheel 12*a* and pinion 12*b* which together form the seconds wheel composite which controls the motion of the seconds hand. As shown in FIG. 3, battery 2 has a body portion 2*a* of large diameter and a terminal 2*b* of a smaller diameter. The periphery of fourth wheel 12*a* lies close to body portion 2*a* and the periphery of center wheel 14*a* lies beneath body portion 2 and thus close to terminal portion 2*a* as shown more clearly in FIG. 4. Battery 2 also lies close to the outer periphery of plate 1**.

Rotor **6*b* is mounted on pivot 6 which is guided and supported by plate 1 and bridge 4. Rotor 6*b* is positioned between stators 7 and 8 connected to coil 9. According to the conventional manner, rotor 6*b*** completes a revolution every 2 seconds as the result of the magnetic attraction and repulsion generated by pulse signals which alternate in polarity and come from the circuit portion of the timepiece.

Also positioned between plate 1 and bridge 4 are pivot 10 carrying sixth wheel **10*a* and pinion 10*b* and pivot 11 carrying fifth wheel 11*b* and pinion 11*a*, pinion 11*a* mating with fourth wheel 12*a* which is mounted on pivot 12**. It will be noted that the reference characters have been selected so that elements having the same reference numeral are mounted on a pivot also carrying the same reference numeral. In addition, mating partners, said partners being a wheel and a pinion, are labelled with the same letter.

In the operation of the gear train, sixth wheel **10*a* is driven by rotor pinion 6*a*, the drive then proceeding with three stages of speed reduction through sixth wheel pinion 10*b* to fifth wheel 11*b* and thence through fifth wheel pinion 11*a* to fourth wheel 12*a*. Wheel 12*a* and fourth wheel pinion 12*b* constitute the seconds wheel composite for displaying seconds. The drive proceeds further from fourth wheel pinion 12*b* to wheel 13*b* on pivot 13 and from third wheel pinion 13*a* to center wheel 14*a* and pivot 14** for showing the minutes and the hours.

Critical to the operation is the manner in which speed reduction is carried out, the significant features being the ratios in the number of teeth and the module of each pair of mating gears. The module conventionally being defined as the diameter of the pitch circle of a gear or wheel divided by the number of teeth thereon. Two embodiments within the scope of the present invention are illustrated in the following Table.

TABLE

| | No. of teeth | module | | No. of teeth | module |
|---|---|---|---|---|---|
| rotor pinion | 10 | 0.066 | rotor pinion | 7 | 0.064 |
| sixth wheel | 40 | | sixth wheel | 42 | |
| sixth wheel pinion | 7 | 0.065 | sixth wheel pinion | 9 | 0.070 |
| fifth wheel | 42 | | fifth wheel | 36 | |
| fifth wheel pinion | 48 | 0.032 | fifth wheel pinion | 36 | 0.042 |
| fourth wheel | 60 | | fourth wheel | 45 | |
| fourth wheel pinion | 6 | 0.062 | fourth wheel pinion | 6 | 0.066 |
| third wheel | 48 | | third wheel | 45 | |
| third wheel pinion | 6 | 0.065 | third wheel pinion | 6 | 0.062 |
| center wheel | 45 | | center wheel | 48 | |

As can be seen from the above Table, the module of each of the combinations of fourth wheel and fifth wheel pinion lie in the range of about $\frac{1}{2}$ to $\frac{2}{3}$ of the value of the other combinations. Accordingly, the module or pitch interval of the teeth on these gears is sufficiently great so that production difficulties are avoided. In addition, in the absence of a friction spring no load from such a source is placed upon the wheels and the torque required for driving the system is much smaller than that of the mechanical timepiece. More specifically, a torque of about 0.1 g-cm must be provided for driving the fourth wheel and pinion of a small-sized mechanical timepiece in order to overcome the maximum torque of the friction spring. However, in an electric timepiece utilizing a gear train as disclosed herein, the torque need only be 0.05 g-cm which is about half that required for mechanical timepieces. Actually, the maximum torque is necessary to cope with the load imposed by shifting of the hands and that of the calendar.

Figure 9:
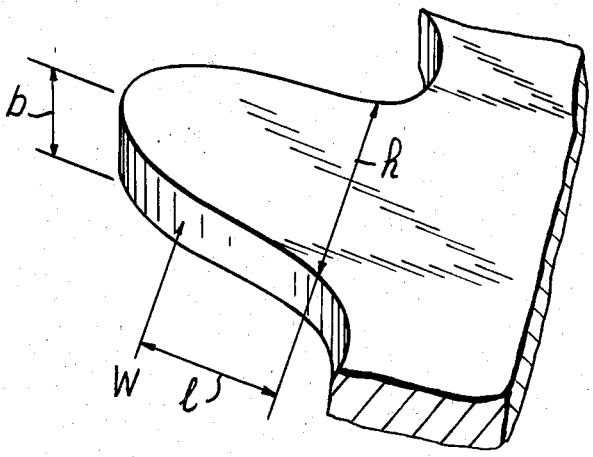
FIG. 9 is a perspective view of a gear tooth.

Since the load on the gears of the structure disclosed herein is so small, the strength of the gears may be reduced. As can be seen from FIG. 9, the length of a gear tooth is labelled as l, the thickness of a gear tooth is indicated with the reference letter b and the width of the face of a gear tooth is taken as h. The strength of a wheel may then be expressed by the formula:

$$\sigma=(6Wl/bh^2),$$

where W is the power transmitted to the wheel. As is evident from FIG. 4, space is available for providing a tooth thickness which is at least twice as great as that of other wheels while the torque (W×l) exerted on the wheel is about half. Accordingly, even where the module is small relative to the modules of the other gears, the same wheel strength can be obtained.

From the standpoint of processing and production, it is very difficult to reduce the size of the gear train portion below a certain limit. Attempts to go below this limit are apt to impair the quality of a pinion gear engaging a wheel with a small module. In other words, if the form of the tooth in a pinion is such that it has a small module and the pinion has a small number of teeth, the root diameter of the pinion becomes prohibitively small and the diameter of the pivot on which the pinion is mounted cannot be controlled with the requisite precision.

In accordance with the present invention, three stages of speed reduction are interposed between rotor 6*b* and the fourth wheel to decrease the speed by a factor of 1/30. Conventionally, this decrease in speed is effected in two stages through the use of a pair of gear ratios such as 1/5:1/6. According to the present invention, the speed reduction ratio of 1/30 is achieved by using the series of gear ratios 1/4:1/6:4/5. Accordingly, the fifth wheel pinion and the fourth wheel have the gear ratio 4/5. Thus, it is possible to construct the fifth wheel pinion 11*a* with a large number of teeth such as 48, in which case the fourth wheel has 60 teeth. As another example, the fifth wheel pinion may have 36 teeth and the fourth wheel then will have 45 teeth.

Because the number of teeth in fifth wheel pinion 11*a* which engages the fourth wheel is large, the root diameter must be relatively large. The large root diameter makes possible the use of a pivot of substantial diameter and equally substantial strength. Cutting of the fourth wheel gear and pinion and the fifth wheel pinion can then be performed by hobbing. A gear train in accordance with the present invention is suitable for mass production in the same fashion as is carried out with respect to the gear trains of mechanical timepieces.

Figure 5:
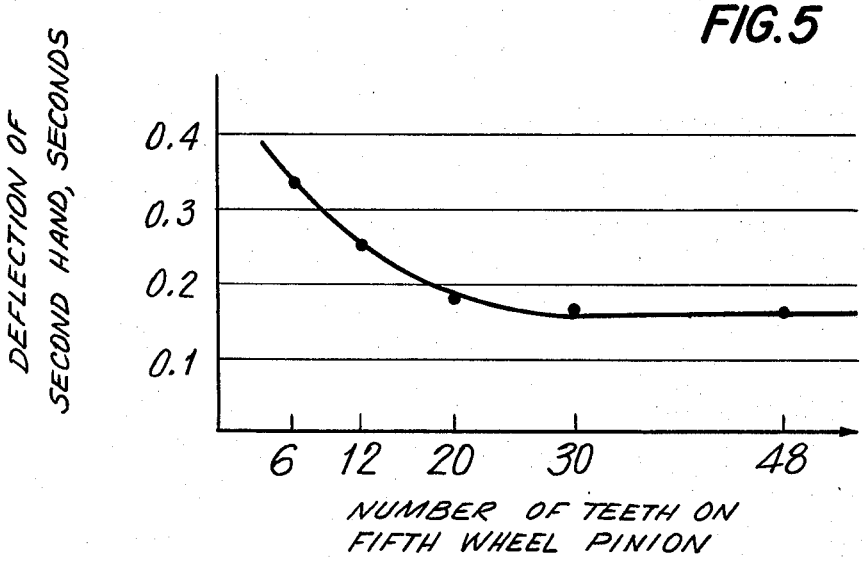
FIG. 5 is a graph showing the interrelationship between the deflection of the second hand and the number of teeth on the pinion which engages with the second wheel composite consisting of the fourth wheel and pinion of the gear train.

A further advantage in having a large number of teeth on the pinion engaging the fourth wheel is the decrease in the deflection of the seconds hand. FIG. 5 shows the relationship between the number of teeth in the fifth wheel pinion and the deflection of the seconds hand. As can be seen from FIG. 5, where the number of teeth in the pinion is less than 12 the deflection increases substantially.

Figure 6:
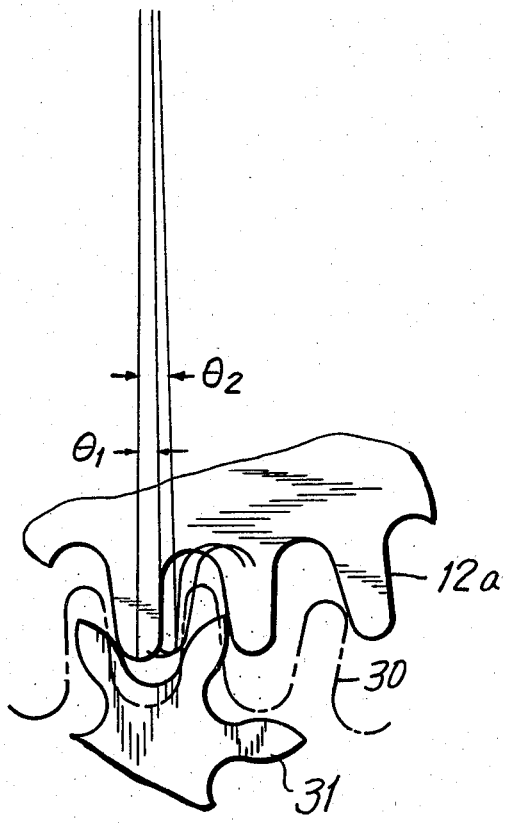
FIG. 6 shows the relative uncertainties of the positioning of the seconds wheel composite when engaged with pinions having 6 teeth and having 48 teeth.

FIG. 6 shows a fourth wheel 12 having 60 teeth in contact with a pinion 11*a* having either 48 teeth as illustrated by the dashed line given the reference numeral 30, or having 6 teeth as illustrated by the solid line given the reference numeral 31. As can be seen from FIG. 6, even if the backlash on the pitch circle is the same for both pinions, the smaller the number of teeth in the pinion, the greater the deflection of fourth wheel 12*a*. Considering the deflection in terms of the angle of rotation of the fourth wheel, where the pinion has 48 teeth, the fourth wheel 12*a* rotates through an angle $\theta_1$ whereas when the pinion has 6 teeth, the fourth wheel rotates through the larger $\theta_2$. The relationship between the number of teeth on fifth wheel pinion 11*a* and the deflection of the second hand, in seconds, is shown in FIG. 5. The deflection reaches a minimum at about 30 teeth for the fifth wheel pinion and is hardly any greater where the number of teeth is 20. Actually, it has been found that the deflection of the seconds hand is within satisfactory limits when the number of teeth on the fifth wheel pinion is greater than 12, and the appearance of the seconds hand of a timepiece is greatly improved.

Figure 10:
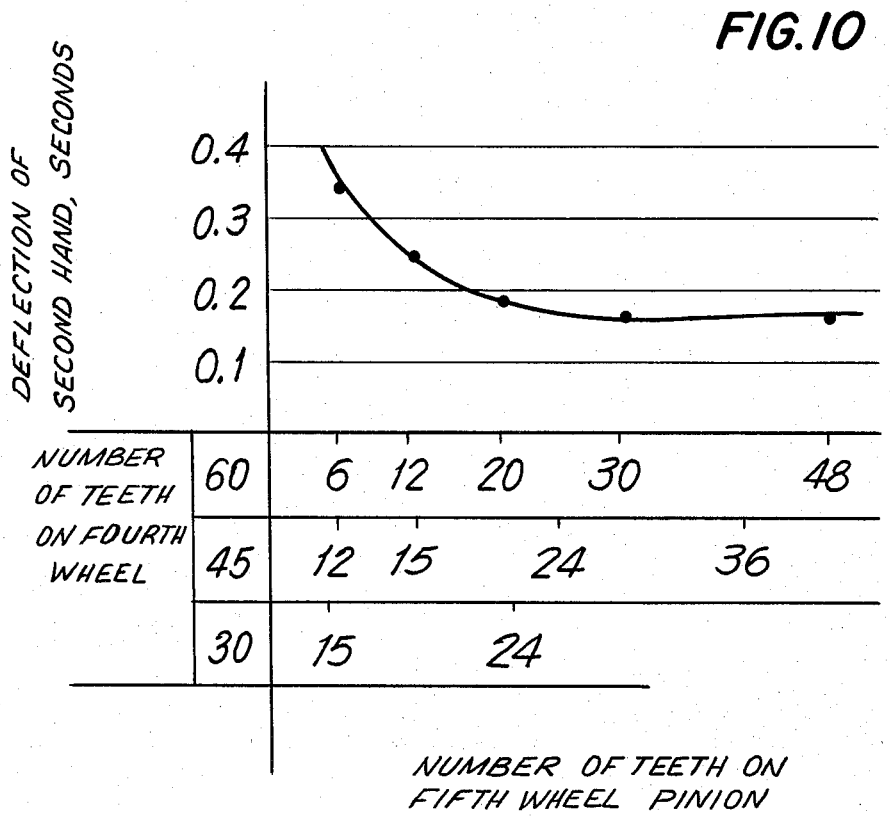
FIG. 10 is a graph showing the relationship between the seconds hand deflection and the number of teeth in the pinion engaging a seconds wheel composite of a gear train within the scope of the present invention.

The deflection of the seconds hand is also influenced by the number of teeth on the fourth wheel 12*b*, relative to the number of teeth on fifth wheel pinion 11*b*. The size of the deflection of the seconds hand, in seconds, as a function of the number of teeth on the fifth wheel pinion for three different numbers of teeth on the fourth wheel is shown in FIG. 10. In each case, the ratio of the number of teeth on fourth wheel to the number on fifth wheel pinion is at least 5:4. As can be seen from FIG. 10, where the fourth wheel has 45 teeth, then the fifth wheel pinion should have at least 24 teeth. For example, taking the number of teeth on the fourth wheel as 45 and on the fifth wheel pinion to be 36, the deflection of the seconds hand is almost the same as when the fourth wheel has 60 teeth and the fifth wheel pinion has 48 teeth. Consequently, it becomes possible to reduce the size of both the fourth wheel and the fifth wheel pinion within the limits shown without suffering any serious loss in the precision with which the seconds hand is located during the stepping operation as it proceeds around the dial. Moreover, the time required for assembling such a timepiece in large scale production is greatly reduced and the appearance of the timepiece is improved.

A further advantage of the gear train taught herein is the elimination of the conventional sweep second cock since all of the gears as well as the rotor are supported between plate 1, full-type bridge 4 and center-wheel bridge 5.

As aforenoted, power transmission of the gear train taught herein is excellent due to the elimination of the friction spring conventionally used in connection with the second hand, the torque of the motor can be reduced and current consumption is likewise reduced so that both the life of the small-sized electronic timepiece and the life of the battery driving said timepiece are greatly lengthened. Moreover, a small-sized electronic timepiece of high quality can be obtained through the structure taught herein.

To take a concrete example, in a gear train of the present invention, a fourth wheel can be used having a diameter which is about 2 mm smaller than that of the conventional wheel using 64 teeth. Where the diameter of the battery is 7.8 mm, if the conventional fourth wheel is used, the module is about 0.06 and the resultant watch is about 20 mm in diameter, but if a gear train in accordance with the present invention is used, a smaller watch having a diameter of about 18 mm can be obtained.

A further advantage of the present construction is that a larger battery may be used than can be used with the conventional construction. This, again lengthens the life of the timepiece over that of a conventional timepiece. Moreover, the value of the product is increased due to the observable increase in precision with which the seconds hand shifts.

Figure 7:
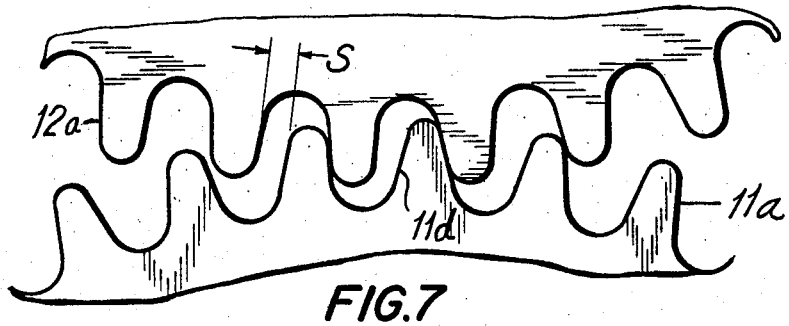
FIG. 7 shows the engagement of the fourth wheel with the fifth wheel pinion in the gear train of the present invention.
Figure 8:
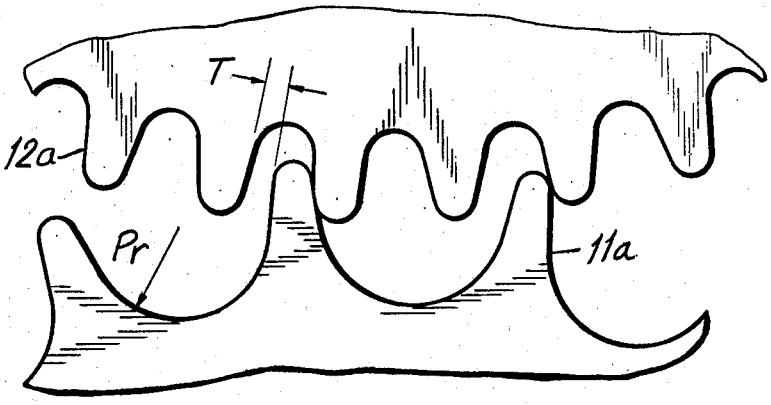
FIG. 8 shows the engagement of the fourth wheel with the fifth wheel pinion where the pitch interval for the fifth wheel pinion is twice that of the fourth wheel.

Another embodiment of the invention in connection with tooth ratios is shown in connection with FIGS. 7 and 8, FIG. 7 showing conventionally-mating teeth and FIG. 8 showing the construction in accordance with the present invention. FIG. 7 shows the teeth of pinion gear 11*a* mating with the teeth of fourth wheel 12*a*, fourth wheel 12 having 60 teeth with a module of 0.032 mm and fifth wheel pinion 11*a* having 48 teeth, fifth wheel 11*a* transmitting energy from the rotor to fourth wheel 12. Reference character S shows the backlash between the teeth of the two gears.

In the construction of FIG. 8 every alternate tooth of pinion gear 11*a* has been removed. Yet, as is evident from a comparison of FIGS. 7 and 8, the backlash T of the new construction is approximately the same as that of the conventional construction, namely S. Accordingly, it is possible to eliminate every alternate tooth, indicated in FIG. 7 as tooth 11*d*, or even every third tooth without making any substantial change in the size of the backlash.

For smooth, certain and effective transfer of energy it is desirable that the fifth wheel pinion have an even number of teeth greater than 18. The advantage of the construction lies in the fact that the radius $P_r$ of the tooth bottom is greater than in the conventional constructions so that it is easy to manufacture the gear by hobbing; also, since it is rare for dust or lint to enter between the teeth, there is little likelihood of stoppage of the watch from such a cause.

In a satisfactory design, the fifth wheel pinion may be a gear with a module of 0.025 to 0.05 mm and the number of teeth in the fourth wheel pinion can be reduced to 30 by eliminating every other tooth in which case the pitch distance of the fourth wheel teeth is twice as great as that of the fifth wheel pinion. In other words, a wheel with a smaller module can be used wherein the number of teeth in the wheel is reduced by elimination of every other tooth in the gear train. The result is that in the engagement of a pair of gears, the module can be half as great as in the usual constructions.

As can be seen, an electronic timepiece of reduced thickness and reduced diameter is achieved by the use of three stages of speed reduction rather than the conventional two stages, grouping the battery and the various gears more closely about the center of the timepiece, using a fifth wheel pinion and a fourth wheel with a large number of teeth so that the module can be reduced without loss or strength and elimination of every other tooth on a pinion. Moreover, the gear train of such a timepiece is more suitable for automatic production on a large and easier to assemble. The saving in labor, particularly, can effect a reduction in the cost of manufacture.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Gear train of an electronic timepiece including a rotor, a battery for powering said rotor, a time-standard generator, time-indicating hands including at least a seconds hand, a plate and an opposed bridge for holding the pivots of the gears in said gear train, said plate having an outer edge, said gear train comprising a plurality of wheel composites in successive stages for transferring the power of said rotor to said time-indicating hands, each of said wheel composites including a wheel and a smaller pinion fixed to a common pivot for rotation together, one of said wheel composites being a seconds wheel composite including a seconds wheel, also termed a fourth wheel, for positioning said seconds hand and another of said composites including a wheel pinion at an earlier stage engaging said fourth wheel, an earlier stage being a component in said gear train between said fourth wheel and said rotor, and wherein said battery is disposed between said fourth wheel and said outer edge of said plate and the periphery of said battery lies proximate said fourth wheel composite and proximate said outer edge of said plate, the module of at least one of said fourth wheel and of said wheel pinion in the earlier stage engaged therewith is smaller than the modules of all other wheels in said gear train, a module of a wheel being the diameter of the pitch circle divided by the number of gear teeth in same, said fourth wheel having a number of teeth greater than at least 30, and all of the wheel composites constituting the gear train being supported on the common pivot to said plate and said opposed bridge.

2. The gear train as defined in claim 1, wherein a gear in an earlier stage of said gear train has more than 12 teeth and a pivot in said earlier stage is rotatably supported in said plate.

3. The gear train as defined in claim 1, wherein the pitch interval of the earlier stage wheel engaging said seconds wheel is twice as long as the module of said seconds wheel, the number of teeth in said seconds wheel gear is 60, and the module of said seconds wheel is from 0.025 mm to 0.05 mm.

4. The gear train as defined in claim 1, wherein said gear train provides three stages of speed reduction between said rotor and said seconds wheel.

5. The gear train as defined in claim 4, wherein said speed reduction stages are $\frac{1}{4}$, 1/6 and 4/5.

6. The gear train as defined in claim 5, wherein said gear train includes a rotor pinion, center wheel and third, fourth, fifth and sixth wheel composites with gear teeth numbers and modules as follows:

| | number of teeth | module |
|---|---|---|
| rotor pinion | 10 | 0.066 |
| sixth wheel | 40 | |
| sixth wheel pinion | 7 | 0.065 |
| fifth wheel | 42 | |
| fifth wheel pinion | 48 | 0.032 |
| fourth wheel | 60 | |
| fourth wheel pinion | 6 | 0.062 |
| third wheel | 48 | |
| third wheel pinion | 6 | 0.065 |
| center wheel | 45 | |

7. The gear train as defined in claim 5, wherein said gear train includes a rotor pinion, center wheel and third, fourth, fifth and sixth wheel composites with gear teeth numbers and modules as follows, modules being pitch intervals:

| | number of teeth | module |
|---|---|---|
| rotor pinion | 7 | 0.064 |
| sixth wheel | 42 | |
| sixth wheel pinion | 9 | 0.070 |

-continued

| | number of teeth | module |
|---|---|---|
| fifth wheel | 36 | |
| fifth wheel pinion | 36 | 0.042 |
| fourth wheel | 45 | |
| fourth wheel pinion | 6 | 0.066 |
| third wheel | 45 | |
| third wheel pinion | 6 | 0.062 |
| center wheel | 48 | |

8. The gear train as defined in claim 1, wherein the number of teeth in and the module of the wheel engaging said seconds wheel are, respectively, greater than 18 and from 0.025 mm to 0.05 mm, the number of teeth in said seconds wheel is 30 and the module of said seconds wheel is twice as great as the module of said wheel engaging said seconds wheel.

9. The gear train as defined in claim 1, wherein said gear train includes at least one wheel and pinion engaged with said wheel for driving same, one of said wheel and pinion having a module which is half that of the other.

10. The gear train as defined in claim 1, wherein said gear train includes at least one wheel and pinion engaged with said wheel for driving same, one of said wheel and pinion having a module which is $\frac{1}{3}$ that of the other.

11. The gear train for an electronic timepiece of claim 1, wherein the wheel composite having the wheel pinion engaged with said fourth wheel includes a wheel having the same module as that of the remaining wheels in the gear train which pivot on the same plate and bridge.

* * * * *